US007603996B2

(12) United States Patent
Wei

(10) Patent No.: US 7,603,996 B2
(45) Date of Patent: Oct. 20, 2009

(54) STRUCTURE OF CHANGING GAS CYLINDER FOR AIR GUNS AND PAINTBALL GUNS

(76) Inventor: Wilson Wei, P.O. Box 24-108, Taipei (TW)

( * ) Notice: Subject to any disclaimer, the term of this patent is extended or adjusted under 35 U.S.C. 154(b) by 286 days.

(21) Appl. No.: 11/165,516

(22) Filed: Jun. 24, 2005

(65) Prior Publication Data

US 2006/0288990 A1 Dec. 28, 2006

(51) Int. Cl.
*F41B 11/00* (2006.01)
*F41C 23/10* (2006.01)
*F41C 23/22* (2006.01)

(52) U.S. Cl. ..... 124/74; 124/80; 42/71.02

(58) Field of Classification Search ..... 124/70–77, 124/80; 42/71.02, 72, 73, 74
See application file for complete search history.

(56) References Cited

U.S. PATENT DOCUMENTS 2,057,169 A * 10/1936 Swenson ..... 42/5
3,207,143 A * 9/1965 Kline et al. ..... 124/76
4,219,953 A * 9/1980 Musgrave ..... 42/1.02
4,286,401 A * 9/1981 Pachmayr et al. ..... 42/71.02
4,344,410 A * 8/1982 Curran ..... 124/80
4,614,052 A * 9/1986 Brown et al. ..... 42/87
5,231,237 A * 7/1993 Cupp ..... 42/71.02
5,517,780 A * 5/1996 Haber et al. ..... 42/70.08
5,621,997 A * 4/1997 Pearce ..... 42/71.02
5,711,286 A * 1/1998 Petrosyan et al. ..... 124/73
5,768,817 A * 6/1998 Simons ..... 42/71.02
6,026,797 A * 2/2000 Maeda et al. ..... 124/74
6,029,645 A * 2/2000 Wonisch et al. ..... 124/74
6,112,446 A * 9/2000 Forster et al. ..... 42/71.02
6,494,194 B2 * 12/2002 Shipachev et al. ..... 124/73
6,578,565 B2 * 6/2003 Casas Salva ..... 124/73
6,637,450 B2 * 10/2003 Huang ..... 137/68.3
2003/0084601 A1 * 5/2003 Kunimoto ..... 42/27
2004/0200466 A1 * 10/2004 Salva ..... 124/74
2006/0201491 A1 * 9/2006 Wei ..... 124/74
2006/0260596 A1 * 11/2006 Maeda et al. ..... 124/74
2007/0028911 A1 * 2/2007 Chen ..... 124/74

* cited by examiner

*Primary Examiner*—Troy Chambers

(57) ABSTRACT

A structure for changing gas cylinder for air guns and paintball guns including a bottle frame having a lateral through hole on a gun handle, a prop screwed at the bottom of the bottle frame for moving the gas cylinder upwardly and downwardly, a valve installed at the top of the bottle frame and connected to a gas supply valve tube, a track disposed along both sides of the handle and latched by an embedded member of a U-shape handle cover. The U-shape handle cover is movable along the track between open and closed positions. The gas cylinder can be unloaded from and loaded into the bottle frame without removing the prop or the U-shape handle cover. The U-shape handle cover can be pushed forward along the track to completely seal the pressurized gas cylinder to form a handle without completely removing the prop or the U-shape handle cover.

2 Claims, 5 Drawing Sheets

STRUCTURE OF CHANGING GAS CYLINDER FOR AIR GUNS AND PAINTBALL GUNS

BACKGROUND OF THE INVENTION

1. Field of the Invention

The present invention relates to an improved structure of changing gas cylinder for air guns and paintball guns, which is designed for solving the problems of a slow and inconvenient way of changing the gas cylinder for air guns and paintball guns. A handle of an air gun or a paintball gun forms a bottle frame with a lateral through hole, and a prop is installed at the bottom of the bottle frame, and the prop can be turned by hands to move vertically up and down. A valve connected to a gas supply valve tube is installed at the top of the prop, and a track running along both sides from the front to the rear of the handle, and the track is latched by an embedded member protruded from the interior of a U-shape handle cover, such that the U-shaped handle cover slides along the track to the rear end until it is stopped by the end of the track. It is not necessary to take out the U-shape handle cover to expose the bottle frame. It only needs to turn the prop slightly to move it downward, so that a pressurized gas cylinder can be installed or removed from the side of the bottle frame. If the prop is turned in the opposite direction to move the prop upward to prop the pressurized gas cylinder, then the pressurized gas cylinder is combined with the valve to rapidly release the gas in the cylinder through the valve for shooting. If the U-shape handle cover is moved forward, then the pressurized gas cylinder is covered completely to form the gun handle for users to hold. It is not necessary to remove the prop or the U-shape handle cover to install or remove the pressurized gas cylinder, so as to achieve a fast, easy and convenient operation.

2. Description of the Related Art

Paintball and air gun shooting has become a popular outdoor activity for training individual shooting, sports shooting and teamwork. A paintball gun or air gun usually comes with a high-pressure gas to push the bullets or paintballs, and thus a high-pressure gas storage chamber is provided for installed a pressurized gas cylinder that is connected to a valve to control the discharge of the gas from a gas supply valve tube and facilitate the connection with the gun for shooting. However, a general high-pressure gas storage chamber is tubular in shape and directly installed in the gun handle. To change a pressurized gas cylinder, a valve type prop at the bottom of the gun handle is turned open to remove the exhausted pressurized gas cylinder removed from the bottom of the gun handle and then reinstall a new pressurized gas cylinder. The valve is then turned in the opposite direction to push the prop upward to combine with the valve of the pressurized gas cylinder. Since the displacement of the turning is longer when changing the pressurized gas cylinder, it is time-consuming and inconvenient. Furthermore, the gun handle comes with a protective cover on its side. After the protective cover is removed and the prop is secured, the pressurized gas cylinder can be changed. However, the removed protective cover is separated from the gun handle, and the protective cover may be lost or missing easily, which also results in a time-consuming and inconvenient installation. The activity of the paintball game requires players to make the best of their time, and thus improvements are needed to overcome the foregoing shortcomings.

SUMMARY OF THE INVENTION

In view of the shortcomings of the prior arts, the inventor of the present invention based on years of experience on paintball guns and air guns to conduct extensive researches and experiments to overcome the foregoing shortcomings and seek feasible solutions for improvements and finally invented the improved structure of changing gas cylinder for air guns and paintball guns.

The primary objective of the present invention is to provide an improved structure of changing gas cylinder for air guns and paintball guns, which includes a bottle frame having a lateral through hole on a gun handles, a prop screwed at the bottom of the bottle frame and turned by hands to be moved vertically up and down, a valve installed at the top of the bottle frame and connected to a gas supply valve tube, and a track disposed along both sides of the handle and latched by an embedded member of a U-shape handle cover. After the U-shape handle cover is sheathed along the tracks and blocked by the bottom edge of the track, the bottle frame can be exposed without removing the U-shape handle cover. The prop can be screwed downward to unload or install the pressurized gas cylinder, or screwed upward to push the pressurized gas cylinder to move upward, such that the gas cylinder is combined with the valve and expedites the pressurized gas to be discharged from the valve for shooting. The U-shape handle cover can be pushed forward along the track to completely seal and cover the pressurized gas cylinder to form a handle for users to hold the gun without completely removing the prop or the U-shape handle cover to change the pressurized gas cylinder so as to give a quick, easy and convenient operation.

The secondary objective of the present invention is to provide an improved structure of changing gas cylinder for air guns and paintball guns, which extends the lower end of the U-shape handle cover such that when the U-shape handle cover slides forward along the track, a knob of the prop at the bottom of the bottle frame can be sealed and covered, so as to prevent it from being scratched and improve its artistic look.

DETAILED DESCRIPTION OF THE PREFERRED EMBODIMENTS

To make it easier for our examiner to understand the present invention, the following detailed description with reference to the accompanying drawings of an embodiment are given for example, but such preferred embodiment is not intended to limit the scope of the present invention.

Figure 1:
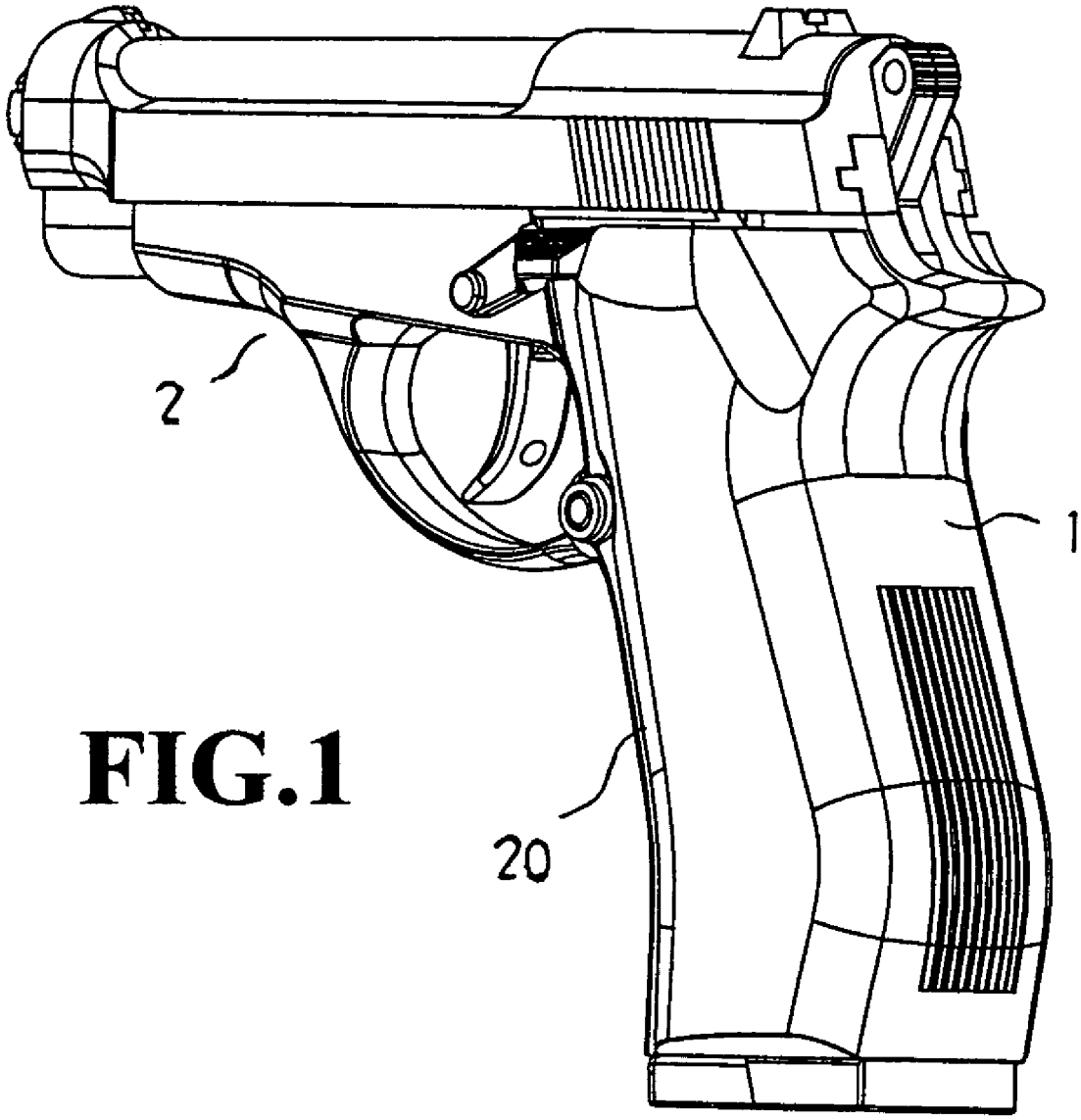
FIG. 1 is a perspective view of a first preferred embodiment of the present invention.
Figure 2:
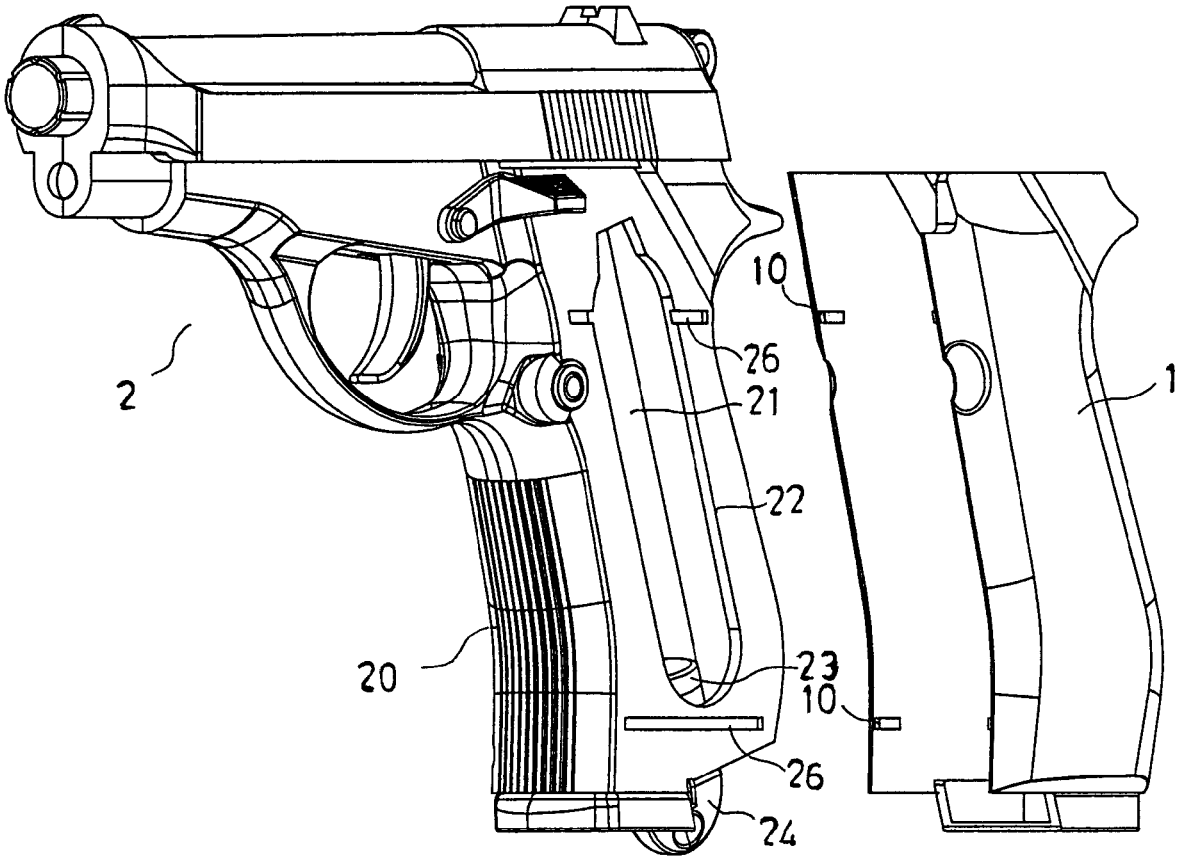
FIG. 2 is an exploded view of a first preferred embodiment of the present invention.
Figure 3:
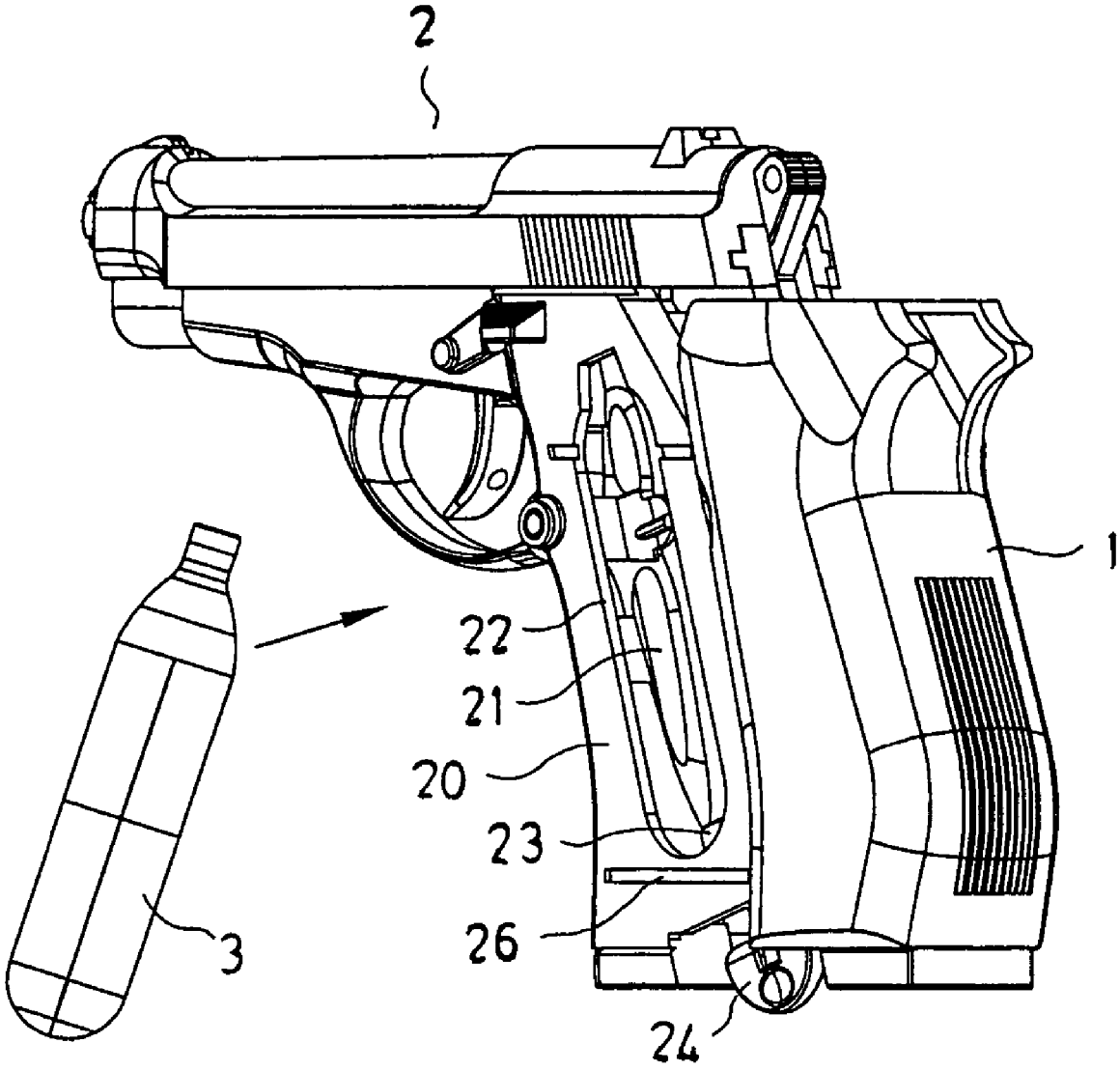
FIG. 3 is a schematic view of a first preferred embodiment of the present invention.
Figure 4:
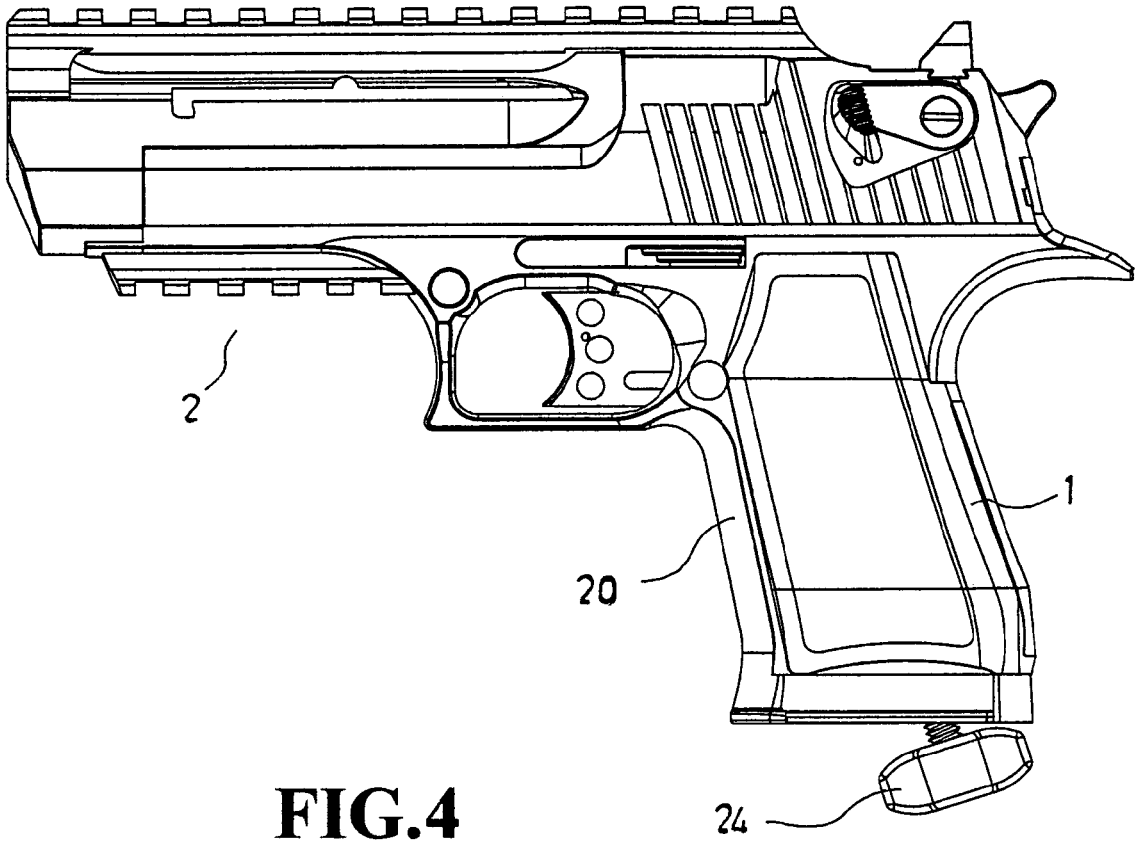
FIG. 4 is a side view of a second preferred embodiment of the present invention.
Figure 5:
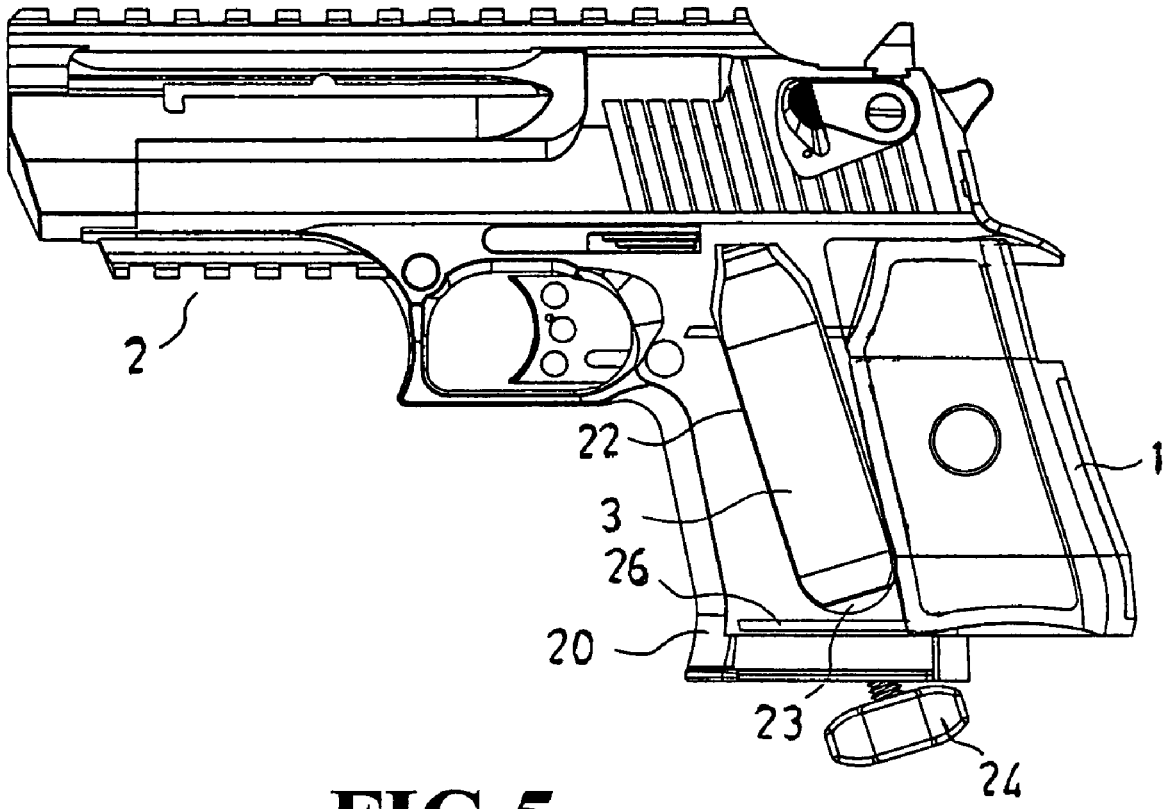
FIG. 5 is a schematic side view of the structure when used according to a second preferred embodiment of the present invention.

Referring to the figures, the improved structure of the present invention comprises a U-shape handle cover 1 and a gun 2; wherein the gun 2 forms a bottle frame 22 having a lateral through hole 21 at the handle 20, and a prop 23 is installed at the bottom of the bottle frame 22, and the prop 23 can be turned by a knob 24 to move vertically up and down, and a valve (not shown in the figure) is installed at the top of the bottle frame 22 and connected to a gas supply valve tube, and a track 26 is disposed from the front to the rear along both sides of the handle 20. The track 26 is latched by an embedded member 10 inside the U-shape handle cover 1, and the U-shape handle cover 1 is moved towards backward along the track 26 to expose the bottle frame 22. If the U-shape handle cover 1 is moved forward, the bottle frame 22 is sealed and covered to form the gun handle for users to hold. Further, the bottom of the U-shape handle cover 1 is extended downward as shown in FIGS. 1 to 3, such that when the U-shape handle 1 moves forward along the track 26, the knob 24 of the prop 23 at the bottom of the bottle frame can be wrapped and covered in the U-shape handle cover 1.

In actual practice, the U-shape handle cover 1 is made of a plastic material, so that after it is propped to be latch into the track 26 by the embedded member 10 and clamped on the handle 20 of the gun 2. If a user wants to install or change the pressurized gas cylinder 3 of the gun 2, the U-shape handle cover 1 is moved backward along the track 26. Since the track 26 is stopped by its bottom edge, therefore it is not necessary to remove the U-shape handle cover 1 to expose the bottle frame 22. A user only needs to slightly turn the knob 24 to move the prop 23 upward for removing or installing the pressurized gas cylinder 3 from a lateral side of the bottle frame. The knob 24 can be turned slightly in the opposite direction to push the prop 23 upward to combine the pressurized gas cylinder with the valve so as to control the pressurized gas to discharge from the cylinder through the gas supply valve tube and facilitate the gun for shooting. If the U-shape handle cover 1 is pushed forward along the track 26, the pressurized gas cylinder 3 is sealed and covered completely to form a gun handle. Since the pressurized gas cylinder of the invention is installed from a lateral side of the bottle frame 22, the displacement of the prop is shorter, and it is not necessary to remove the prop 23 or the U-shape handle 1 to install or change the pressurized gas cylinder 3, so as to achieve a quick and convenient operation. If the U-shape handle cover 1 is moved forward along the track 26, the bottom of the U-shape handle cover 1 covers the knob 24 of the prop 23 at the bottom of the bottle frame 22 to prevent the knob 24 from being loosened or scratched. Such arrangement also improves the artistic look of the gun.

In summation of the description above, the structure and device of the present invention are novel, not only providing a quick and convenient way for installing or removing the pressurized gas cylinder, but also providing protecting the knob and improving the artistic look of the gun. The present invention has significant improved effects and also complies with the patent application requirements. The description and its accompanied drawings are used for describing preferred embodiments of the present invention, and it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A structure for changing a gas cylinder for air guns and paintball guns comprising:

a) a gun having a handle having:

i) a bottle frame having a lateral through hole located therein for accommodating the gas cylinder;

ii) a prop located in a bottom of the bottle frame and being movable upwardly and downwardly between first and second positions iii) a knob selectively moving the prop between first and second positions;

iv) a valve located at a top of the bottle frame and connected to a gas supply valve tube; and v) a track located on each of two opposing sides of the handle and extending from a front to a rear of each side of the handle; and b) a handle cover being a U-shaped structure and having:

i) an embedded member located on each of two opposing handle cover sides thereof and inserted into a corresponding track, the handle cover is movable along the track between open and closed positions, the open position corresponding to a maximum travel distance of the handle cover along the track in a direction away from the bottle frame; and ii) a bottom cover selectively covering the knob, wherein, when the handle cover is located in the closed position, the handle cover covers the bottle frame and the knob; and, when the handle cover is located in the open position, the handle cover is spaced apart from the bottle frame and the knob, the open position exposing the lateral through hole of the bottle frame to allow the gas cylinder to be selectively inserted into and removed from the bottle frame through a side of the handle of the gun, wherein, during the reloading of the gas cylinder, the handle cover is configured to remain connected to the handle of the gun in both the open position and the closed position.

2. The structure according to claim 1, wherein, when the handle cover is located in the closed position, the handle cover covering the two opposing sides and a back of the handle of the gun.

* * * * *